United States Patent [19]

Tylka

[11] 4,114,068

[45] Sep. 12, 1978

[54] SPARK PLUG WITH COMBUSTION PRESSURE SWITCHES

[76] Inventor: Etler-Peter Tylka, Schillerstrasse 34, D-4402 Graven-Reckenfeld, Germany

[21] Appl. No.: 800,950

[22] Filed: May 26, 1977

[30] Foreign Application Priority Data

May 29, 1976 [DE] Fed. Rep. of Germany ..... 2624238

[51] Int. Cl.[2] ..... H01T 13/40

[52] U.S. Cl. ..... 315/51; 315/56; 315/73; 313/126

[58] Field of Search ..... 315/51, 53, 56, 72, 315/50, 32, 112, 73; 313/126

[56] References Cited

U.S. PATENT DOCUMENTS

| | | | |
|---|---|---|---|
| 1,213,637 | 1/1917 | Heginbottom | 315/56 |
| 1,315,002 | 9/1919 | Atkinson et al. | 315/56 X |
| 3,361,929 | 1/1958 | Vandover | 313/126 X |

*Primary Examiner*—Alfred E. Smith
*Assistant Examiner*—Charles F. Roberts
*Attorney, Agent, or Firm*—Cushman, Darby & Cushman

[57] ABSTRACT

A spark plug for an internal combustion engine, the spark plug comprising a casing, a center electrode, a connector pin for the center electrode, and a plunger adapted to be axially displaced within the spark plug by the compression pressure as pressure builds in the cylinder, the plunger first closes a set of contacts in the spark plug causing current to flow in the primary side of an ignition coil, then closes a second set of contacts in the spark plug connecting the center electrode to the secondary side of the ignition coil, and finally opens the first set of contacts causing a large voltage to be induced in the secondary side which voltage is applied to the center electrode.

17 Claims, 5 Drawing Figures

SPARK PLUG WITH COMBUSTION PRESSURE SWITCHES

The present invention relates to a spark plug for an internal combustion engine having a battery or magneto ignition system including an ignition coil, with the spark plug comprising a casing or body, a center electrode and a connector pin for the center electrode.

Conventional spark plugs for the ignition of a combustible mixture within a combustion chamber of the engine are fed, via the connector pin, with an ignition voltage which produces ignition sparks flashing over from the center electrode to one or more grounded electrodes. For the production of the ignition voltage and for distributing the ignition voltage to the spark plugs associated with the separate combustion chambers of the engine, a conventional ignition system in addition to a voltage source comprises an ignition coil, a breaker, a distributor, a centrifugal governor and a vacuum controller. The breaker serves to break the circuit formed by the voltage source and the primary winding of the ignition coil, whereby a high voltage is induced in the secondary winding of the ignition coil. The distributor is interconnected between the secondary coil and the separate spark plugs, said distributor transmitting the ignition voltage to one of the spark plugs each. Hereby, the opening movement of the breaker and the rotary movement of the distributer are controlled by the crankshaft of the engine directly or indirectly.

Accordingly, the production and distribution of the ignition voltage in conventional battery and magneto ignition systems requires a relatively complex construction of such systems and a mechanical connection from the breaker thereof and from the ignition distributor to the crankshaft of the engine.

It is the object of the present invention to provide a spark plug which allows to simplify the ignition system.

In a spark plug of the type as outlined above, this object is solved by a plunger adapted to be axially displaced interiorly of said spark plug by the compression pressure; a first pair of contacts disposed between said connector pin and said center electrode, which contacts are closed by movement of said plunger; a terminal for connection to the primary winding of said ignition coil; and a second pair of contacts arranged between ground (potential) and said terminal, which contacts are closed and opened by movement of said plunger.

The spark plug according to the invention has its connector pin connected directly to the secondary winding of the ignition coil without the interconnection of an ignition distributor, and its primary winding terminal is connected directly to the primary winding of the ignition coil. When the pressure rises during the combustion cycle taking place within a combustion chamber of the engine, this pressure displaces the plunger of the spark plug according to the invention. Such displacement results in that the second pair contacts is closed first, thereby closing the primary circuit of the ignition coil. Further displacement of the plunger by the compression pressure causes said second pair of contacts to be re-opened, whereby primary winding becomes deenergized and the ignition voltage is produced in the secondary winding. Prior to the opening of the second pair of contacts, the first pair of contacts has been closed, such that the ignition voltage is allowed to be applied to the center electrode, thereby producing flash over of the spark. Consequently, neither is a breaker positioned exteriorly of the spark plug required for the production of the ignition voltage, nor does the application of the ignition voltage to the spark plug as is necessary to produce a spark at a given point of time, necessitate an ignition distributor. Thus, the spark plug according to the invention allows to substantially simplify the ignition system with a corresponding reduction of the cost of such system. Another advantage of the invention resides in the fact that potential causes of trouble in the ignition system are avoided because of the absence of the ignition distributor and of the breaker.

The opposing force or bias which returns the plunger in the spark plug into its initial or rest position, may be provided by a compression spring biasing the plunger in opposition to the compression pressure, and/or a gas pressure acting within a pressure chamber which is formed in the casing on the side of the plunger directed away from the combustion chamber of the engine and communicating with the combustion chamber of the engine through at least one passage providing a throttling effect; in advantageous embodiment of the invention, means are provided to break or shut off such communication in the course of the plunger stroke. A pressure chamber of this type provides for automatic variation of the preignition (spark advance) by the spark plug with increasing rate of engine speed. As known, the degree of preignition should be higher with incrasing rate of speed. In this construction, the throttling or restricted passage ensure that at higher rates of speed and therefore increasingly faster pressure rise during the compression stroke in the combustion chamber, the pressure produced in the pressure chamber is prevented from following the pressure rise taking place within the combustion chamber to the same degree as at lower rates of speed and therefore slower pressure rise within the combustion chamber. Accordingly, at the point of time when the passage is closed, the pressure existing within the pressure chamber is lower at higher rates of speed than at low rates of speed, such that the bias acting upon the plunger is lower, and the latter, thus, closes and opens the second contact pair already at a lower level of the compression pressure, thereby to produce the ignition voltage. This means that the preignition angle is greater, as is desired, at higher rates of speed.

In order to allow the spark plug according to the invention to be adapted to engines of different characteristic values, in preferred embodiment it is contemplated that the position of the plunger in which the latter closes or opens, respectively, the first pair or contacts and/or the second pair of contacts, is adjustable or variable.

In the preferred embodiments of the invention the center electrode is positioned in the movable plunger such that this electrode is likewise moved relative to the grounded electrode. This results in the additional advantage that formation of bridges between the electrodes by combustion products, such as soot and coked oil, is prevented from occuring since such bridges would be broken up immediately. Another advantage also resides in the fact that moist electrodes are more quickly dried by the movement of the center electrode.

Advantageous embodiments and further developments of the spark plug according to the invention are characterized in the subclaims. Further advantages and features of the invention are apparent from the following explanation of preferred embodiments by referring to the drawings, wherein:

Figure 1:
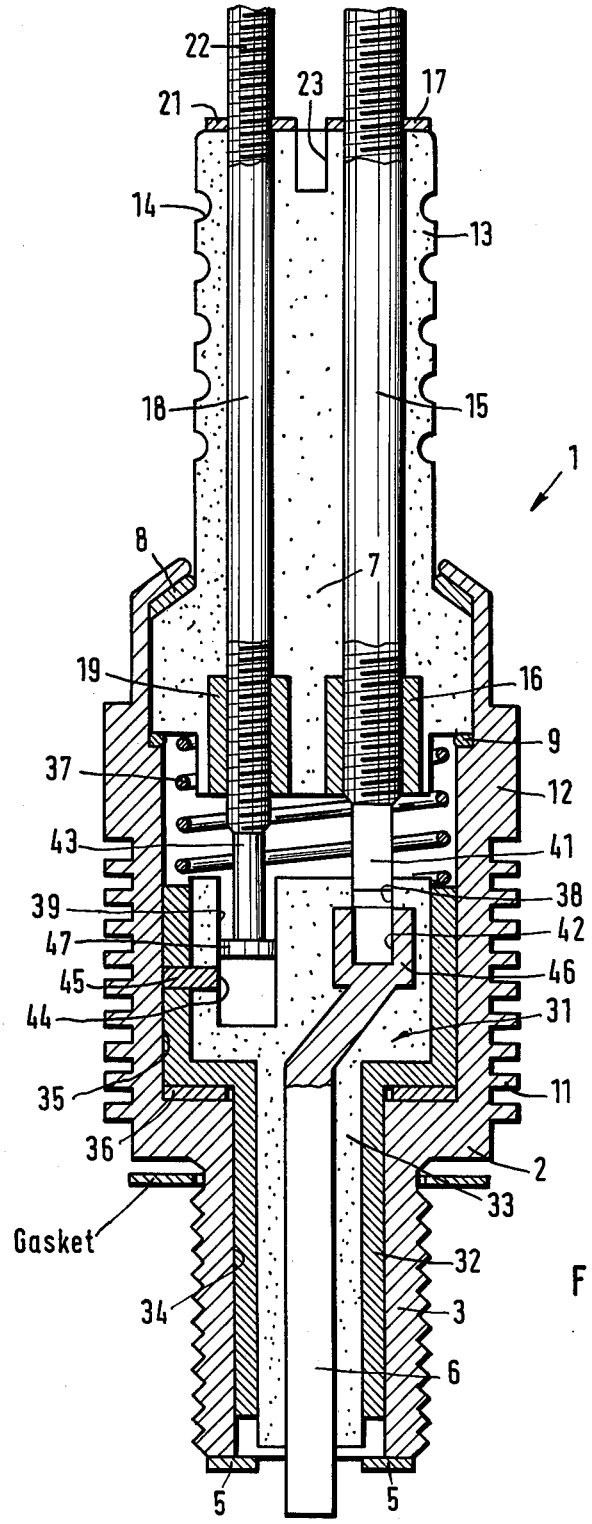
FIG. 1 is a longitudinal sectional view of the first embodiment of a spark plug according to the present invention.

The spark plug 1 shown in FIG. 1 includes a metallic casing or body 2 adapted to be threaded into a not illustrated cylinder head by means of an externally threaded (screw-in) portion 3 at the lower end thereof. Grounded electrodes 5 are attached to the lower end of the threaded portion 3, so as to surround a center electrode 6 protruding from the lower end of the casing. At the upper end of the casing 2, an insulator body 7 is securely mounted within the casing 2, with gaskets 8 and 9 being provided between the casing and a shoulder of the insulator body. Annular cooling fins 11 are formed in the outer surface of the casing 2 adjacent the threaded portion, to provide for improved heat dissipation. Above the cooling fins, the casing is formed with a hexagon 12 which may be engaged with a spark plug wrench.

The insulator body 7 is formed of the heat resistant ceramic material normally used for spark plugs, and this body has a substantially cylindrical configuration. The upper portion 13 of said body which protrudes from the casing is provided with peripheral annular grooves acting to increase the path to leakage currents. A connector pin 15 passes through the insulator body 7 in parallel with the longitudinal axis of the latter, which pin is slidable within a complementary aperture of the insulatur body. At the lower end of said aperture, an internally threaded bushing or sleeve 16 is securely mounted in the insulator body 7. In the manner as shown, the connector pin is externally threaded both in the region of the threaded sleeve 16 and in its upper portion projecting out from the insulator body. The lower threads of the connector pin 15 are screwed into the threaded sleeve 16. A nut 17 is threaded onto the threads at the upper end of the connector pin, which nut acts to check or lock the connector pin threaded into the threaded sleeve 16. By tightening the nut 17 and rotating the connector pin 15 and subsquently locking the latter by means of nut 17, the connector pin may be secured within a certain range of adjustment in a desired position relative to the insulator body.

A conductor 18 extends in parallel with the connector pin 15 through the insulator body 7, which conductor, in the same way as the connector pin 15, is secured to the insulator body by a threaded sleeve 19 and a nut 21 and adapted to be adjusted relative to said insulator body. In the case of predetermined engine characteristics, the threaded sleeve 19 accordings to FIG. 1 may be omitted, or components 61 and 2 according to FIG. 4 or components 73 and 3 according to FIG. 5, respectively, may be formed integrally. The threaded upper end 22 of the conductor 18 forms the terminal for connecting the spark plug to a primary winding of an ignition coil, as will be explained later. In the upper face of the insulator body 7, a groove 23 is formed between the connector pin 15 and the conductor 18, into which groove a web or ridge 24 of the cap 25 of a plug socket (compare FIG. 4) may engage, which cap forms part of the not separately shown two-terminal plug socket. Groove 23 and web 24 in cooperation prevent leakage currents from flowing between the conductor 18 and the connector pin 15.

Casing 2 has slidably disposed therein a plunger 31 of cylindrical configuration and comprising a metallic jacket or shell 32 and a core 33 of an insulating material. Plunger 31 is formed as a stepped piston, with the smaller diameter portion of the plunger being guided by a guide surface 34 interiorly of the threaded portion 3 of the casing, and the greater diameter portion being guided by a guide surface 35 formed in the center portion of the casing 2. Interposed between the step formed in the plunger and the mating step of the casing connecting the guide surfaces 34 and 35, there is a ring 36 formed of a softer material, upon which ring the plunger rests in its lowermost position (as shown in FIG. 1), and which ring prevents the plunger from forcefully abutting the casing shoulder in the downward movement of the plunger. Interposed between the upper edge of the shell 32 of plunger 31 and the lower face of the insulator body 7 is a compression spring 37 biasing the plunger downwards.

The ceramic material core 33 of plunger 31 being securely mounted to the shell 32 has a first axial aperture (bore) 38 and a second axial aperture (bore) 39 in its upper end face. The first aperture 38 which is positioned coaxially with the connector pin 15, has a diameter adapted to the diameter of a stud 41 formed at the lower end of the connector pin 15, with a clearance fit existing between said stud and the aperture 38 such that the stud and the wall of the aperture are free from contact with each other. A wall portion 42 of the aperture 38 is formed of conductive material, and this portion is formed by the inner surface of a cylinder 46 formed integrally with the center electrode 6. The center electrode 6 is securely inserted into the ceramic material core 33 of the plunger 31 so as to extend coaxially with the latter in the smaller diameter portion thereof.

The second aperture 39 is formed coaxially with the conductor 18. The second aperture 39 has slidingly disposed therein a disc or washer 47 connected to the conductor 18 through a connecting portion 43. Embedded into the wall of aperture 39 is an electrically conductive contact point 44 formed by the end face of a metallic pin or stud 45 inserted into shell 32.

The contact point 44 is positioned in such a fashion, and disc 47 and pin 41 assume such a position, that upon upward movement of the plunger 31 (as shown in FIG. 1) the disc 47 first comes into contact with the contact point 44, whereupon the pin 41 enters the cylinder 46, and, finally, disc 47 comes out of contact with the contact point 44 in the further upward movement of the plunger. In the embodiment shown, the first pair of contacts is formed by pin 41 and the wall portion 42 or the cylinder 46, respectively, while the second pair of contacts is formed by the disc 47 and the contact point 44.

Figure 2:
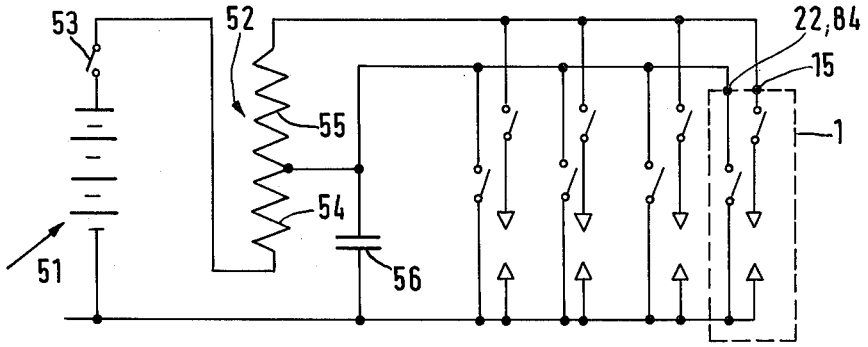
FIG. 2 is a circuit of a battery ignition system of a four-cylinder engine equipped with spark plugs according to the invention.

FIG. 2 shows a circuit diagram of an ignition system of a four-cylinder engine equipped with four spark plugs of the above described type. In FIG. 2, the block outlined in broken lines represents a spark plug 1, wherein the two pairs of contacts and the electrodes are indicated schematically only. The ignition system includes a battery 51 connected to the primary winding 54 of an ignition coil 52 through an ignition switch 53. The secondary winding of the ignition coil 52 is connected in parallel relation to all of the connector pins 15 of the four spark plugs. The ground terminal of the ignition coil 52 is connected to ground potential via an ignition capacitor 56 on the one hand, and connected to all of the conductors 22 of the four spark plugs 1 on the other hand.

Figure 3:
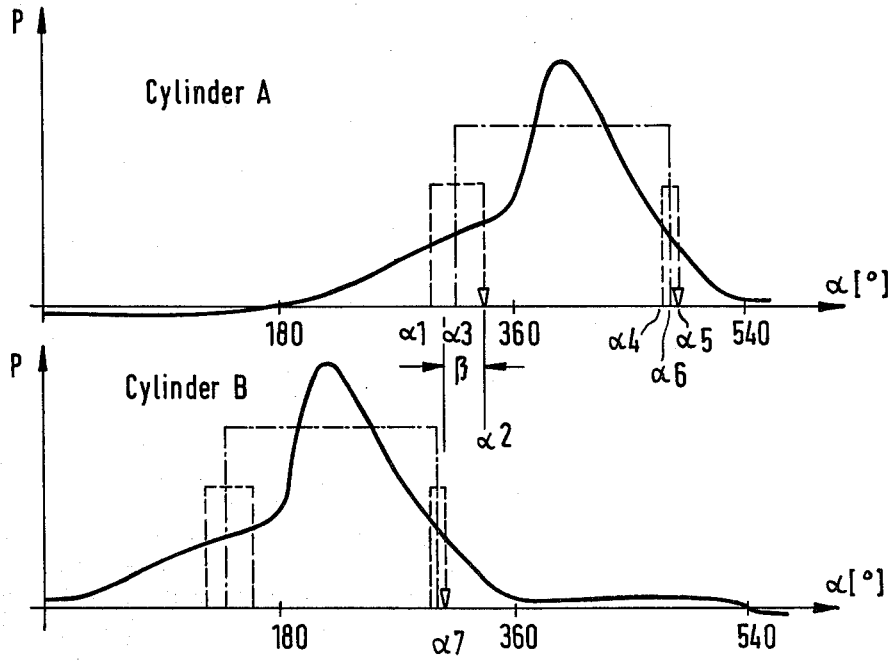
FIG. 3 is a *p, x* diagram representing two cylinders of a four-stroke engine having their working cycles offset from each other by 180°.

FIG. 3 shows schematically a *p*, $\alpha$-diagram, of two cylinders of a four-stroke, four-cylinder engine, with the working cycles of such cylinders being offset from each other by 180°. This diagram indicates above the crank angle $\alpha$ the pressure distribution within the combustion chambers of the cylinders.

In the following, the mode of operation of the spark plug shown in FIG. 1 in an ignition system of the type shown in FIG. 2 is explained in greater detail; in this connection, it may be assumed that the spark plug is associated with cylinder A, the p, $\alpha$ diagram of which is shown in the upper half of FIG. 3. During the intake stroke (0° to 180°), the plunger 31 remains in the position shown in FIG. 1. During the compression stroke (180° to 360°), the pressure within the combustion chamber rises gradually. This compression pressure acts upon the lower end face of plunger 31 so as to move the latter in upward direction as shown in FIG. 1 against the bias of the compression spring 37 and the force generated by the gas enclosed above the plunger. Hereby, disc 47 at a crank angle $\alpha_1$ is brought into contact with contact point 44 whereby the second pair of contacts is closed. This closes the circuit across the primary winding 54. While disc 47 and contact point 44 are still in contact with each other, stud 41 at a crank angle $\alpha_3$ enters the region of wall portion 42 formed by cylinder 46. This closes the first pair of contacts, whereby stud 41 and cylinder 46 act as flashover contacts because of the clearance fit between them. Then, when the plunger is further displaced in upward direction by the compression pressure, at crank angle $\alpha_2$ disc 47 comes out of contact with the contact point 44 such that the primary winding 54 becomes deenergized whereby a high voltage is induced in the secondary winding 55. This voltage is applied to the center electrode 6 through the closed first pair of contacts, such that the ignition spark flashes over between the center electrode 6 and the grounded electrodes 5 at a crank angle $\alpha_2$. The amount of preignition in this instance is 360° - $\alpha_2$. In the subsequent expansion stroke of the plunger between 360° and 540°, the pressure still rises for a short period, whereupon the pressure drops abruptly. Owing to the decreasing pressure within the combustion chamber of the engine, plunger 31 thereafter moves downwards. During such movement, the second pair of contacts is first re-closed at a crank angle $\alpha_4$; thereafter, the first pair of contacts is opened at a crank angle $\alpha_6$, while the second pair of contacts is re-opened at a crank angle $\alpha_5$ before the plunger 31 returns to its initial position shown in FIG. 1 near the end of the expansion stroke. In the case of a single-cylinder engine, the repeated opening of the second pair of contacts at crank angle $\alpha_5$ would likewise result in the generation of the ignition voltage across the secondary winding 55 of the ignition coil 52. However owing to the fact that the first pair of contacts is already open at this point of time, this ignition voltage is not applied to the center electrode 6 such that another flashover of the spark does not take place.

The lower half of FIG. 3 shows the *p*, $\alpha$ diagram of the cylinder the working cycle of which leads the above described working cycle by 180°. For this cylinder, too, the periods during which the second pair of contacts and the first pair of contacts of the spark plug of this cylinder are closed, are shown by the broken curve and dash-dot curve, respectively. It is apparent that the crank angle $\alpha$, at which the second pair of contacts opens in the course of the explosion cycle taking place within this cylinder B, falls within the portion between crank angles $\alpha_1$ and $\alpha_2$ during which the circuit across the primary winding 54 is kept closed, such that no interruption (break) takes place at crank angle $\alpha_7$ and, thus, no ignition voltage is produced. The same applies to crank $\alpha_5$ falling within the range in which the second pair of contacts of a cylinder is closed the working cycle of which lags the working cycle taking place within the cylinder A by 180°. In order to make sure that the second opening of the second pair of contacts at $\alpha_5$ or $\alpha_7$, respectively, does not prevent the desired ignition at $\alpha_2$ (for cylinder A) from being effected, it is only necessary to take care that the difference in crank angles $\beta = \alpha_2 - \alpha_7$ (compare FIG. 3) is greater than zero. If $\alpha_7$ is smaller than $\alpha_1$, then, although an ignition voltage may be produced, no ignition spark is provided since the first pair of contacts of cylinder A is not closed. The above condition may easily be fulfilled on the basis of the pressure distribution within the separate cylinders, by corresponding adjustment and dimensioning of the spark plug. Provided that this condition holds true for two cylinders, for example cylinders A and B, having immediately successive working cycles, then this condition is fulfilled also in the remaining cylinders.

Figure 4:
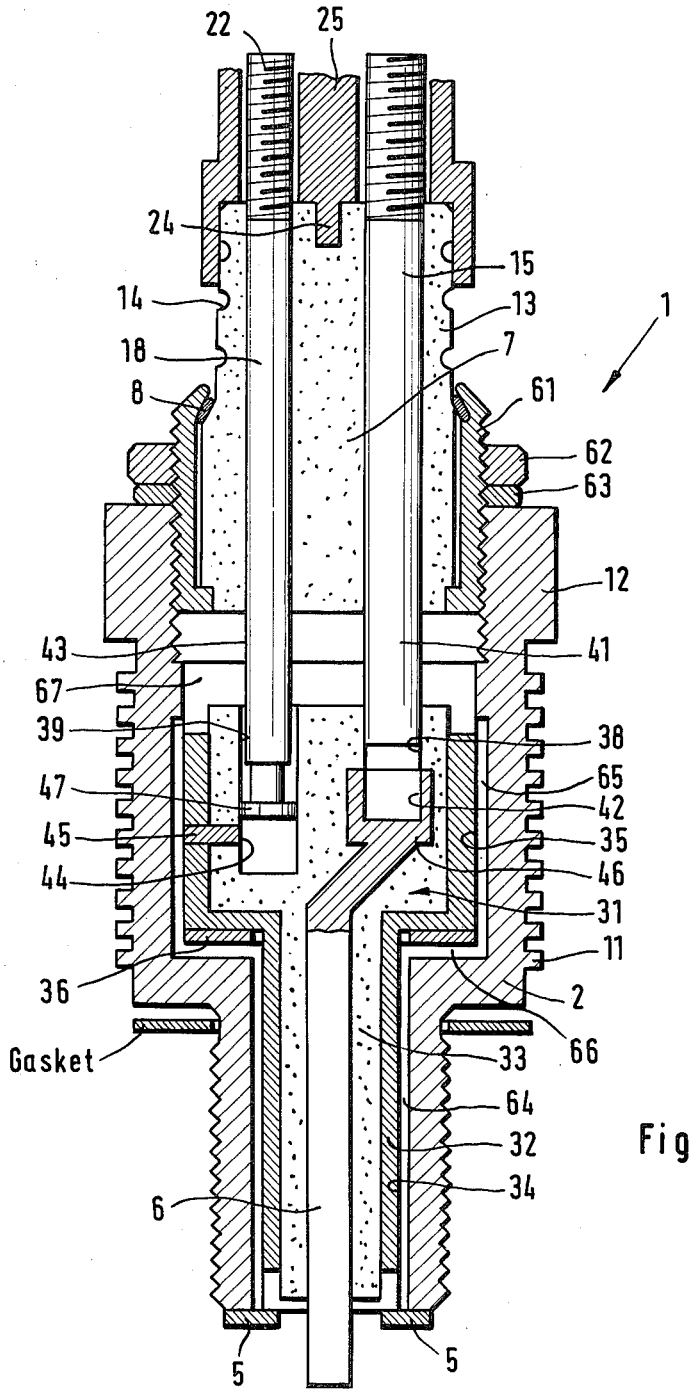
FIG. 4 shows a second embodiment of a spark plug according to the invention.

FIG. 4 shows a second embodiment of a spark plug according to the invention. As far as the compenents of this spark plug are identical to the respective components of the spark plug of FIG. 1, they are identified by the same reference numerals such that a detailed description of these components should be unnecessary. In contrast with the embodiment of FIG. 1, in the spark plug according to FIG. 4 the connector pin 15 and the conductor 18 are mounted in the insulator body 7 in a nonslidable and gas tight fashion such that the threaded sleeves 16 and 19 as well as the locking nuts 17 and 21 of the spark plug of FIG. 1 are omitted. The insulator body 7 is securely inserted into an externally threaded bushing or sleeve 61. This sleeve 61 is threaded into internal threads at the upper end of casing 2, and secured in its position by a nut 62, with a gasket (sealing ring) 63 being provided between such nut and the casing 2. By varying the relative position between the sleeve 61 and the casing 2, the positions of disc 47 and of stud 41 with respect to the plunger 31, and therefore the crank angles $\alpha_1$, $\alpha_2$, $\alpha_3$, $\alpha_4$, $\alpha_5$ and $\alpha_6$ may be varied.

Casing 2 has formed therein at least one passage acting to connect a pressure chamber 67, otherwise sealed in gas tight fashion and openrating as a gas spring, above the plunger 21 to the inner space of the engine when the spark plug is screwed into a cylinder head (not shown). This passage is formed by at least one axial groove 64 formed in the guide surface 34, and one axial groove 65 formed in the guide surface 35 of the casing, with a radial groove 66 interconnecting said axial grooves 64 and 65. The axial groove 65 terminates above the upper edge of the shell 32 of plunger 31. Of course, grooves 64, 65 and 66 do not occupy the full circumference of the guide surfaces; rather, they leave between them sufficient portions of these surfaces such that these surfaces are permitted to fulfill their guiding function. No compression spring is disposed within pressure chamber 67. When the compression pressure has displaced the plunger 31 in upward direction for a given distance, the plunger closes the ends of axial grooves 65 opening to the pressure chamber 67, whereby these grooves are no longer connected to the combustion chamber of the engine.

In this construction, the outlet openings of the passage may be positioned obliquely in such a manner that the gases exiting in the fourth engine cycle are blown against the electrode to thereby clean the latter. At the same time, the passage as such is purged, too. The same applies to the complete spark plug which is in this fashion also cooled.

During the compression stroke, gas may initially flow from the combustion chamber of the engine through the passage formed by grooves 64, 65 and 66 into the pressure chamber 67. However, this flow of gas is restricted by the passage such that the pressure rise within the pressure chamber 67 lags the pressure rise within the combustion chamber of the engine. When the plunger 31 is thereafter displaced in upward direction by the compression pressure to an extent as to close the openings of axial grooves 65, the pressure chamber 67 contains a gas filling, whereby the pressure chamber is effective as a gas spring producing a counter or reaction force proportional to the displacement of the plunger, this, in turn, having the effect that the plunger is then displaced in proportion to the pressure existing within the combustion chamber. At the first and second pairs of contacts, this displacement brings about the same closing and opening operations as explained in connection with the embodiment according to FIG. 1. Owing to the special configuration of the embodiment according to FIG. 4, however, the gas spring automatically conforms itself to the operational conditions or states of the engine and particularly to its speed of rotation. At higher rates of speed and, thus, faster pressure rises within the combustion chamber of the engine, the restriction of the gas flow within the passage defined by grooves 64, 65 and 66 has the effect that at the moment when the opening ends of the axial grooves 65 are closed, the pressure chamber 67 contains a lesser volume of gas than at lower rates of speed when the throttling action of the passage cannot provide a similarly high effect. This results in the "gas spring" becoming weaker, whereby the plunger, already at a lower pressure existing within the combustion chamber of the engine, assumes those positions in which the plunger closes and opens the first pair of contacts, such that the crank angle at which the ignition takes place is more offset from upper dead center; this means that a greater degree of preignition is provided, as is desirable for higher rates of speed.

Figure 5:
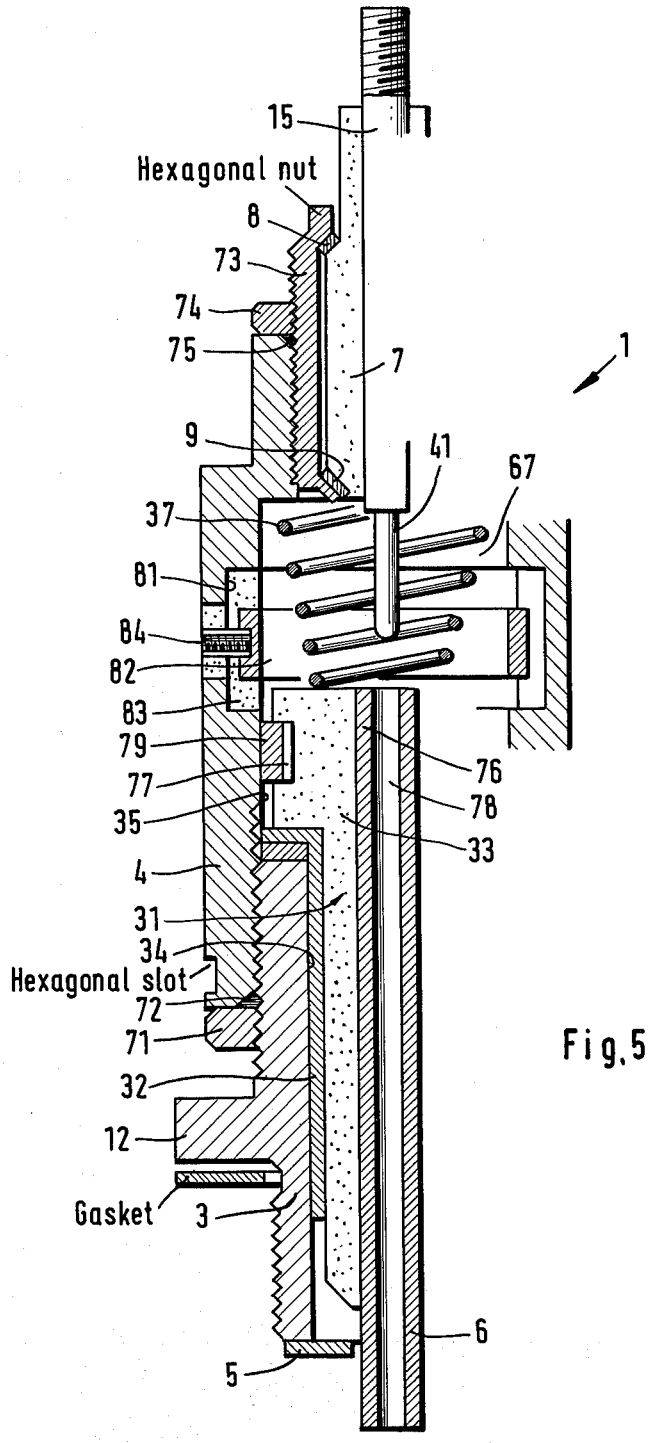
FIG. 5 shows a third embodiment of a spark plug according to the invention.

In the third embodiment of the invention as illustrated in FIG. 5, identical or similar components are again designated with the same reference numerals as in the embodiment according to FIG. 1. In FIG. 5, the casing or body of the spark plug 1 comprises a threaded portion 3 and a cylindrical sleeve portion 4 having internal threads at the lower end thereof and being threadingly engaged with complementary external threads of the threaded portion 3. The position of the sleeve portion 4 on the threaded portion 3 is secured by a nut 71, with an annular sealing ring or gasket 72 being provided between such nut 71 and the lower end of sleeve portion 4. The upper end of the sleeve portion 4 carries a bushing or sleeve 73 screwed into the sleeve portion and provided with external threads, which sleeve is secured in its position on the sleeve portion 4 by a nut 74, with a annular sealing ring or gasket 75 again providing an adequately gas tight seal. The sleeve 73 has securely mounted therein an insulator body 7 supporting a connector pin 15 rigidly mounted in said insulator body 7 in coaxial relation to the casing and provided with threads at the upper end thereof. By varying the axial position of the sleeve 73, within the sleeve portion 4, the relative position between the connector pin 15 and the plunger 31 can be adjusted as desired. The substantially cylindrical plunger 31 comprises a metallic shell 32 and a core 33 of insulating ceramic material. Core 33 has a thinner lower portion and a thicker upper portion, with only the thinner portion being enclosed by the shell 32. A center electrode 6 passes centrally through the core 33 in the axial direction thereof, which electrode has its upper end extending up to the end face of plunger 31 and being provided with an axial bore 78 extending over the full length of the center electrode 6 thereby to establish communication between the space above the plunger 31, formed as pressure chamber 67, and the combustion chamber of the engine when the spark plug 1 is screwed into a cylinder head (not shown). The greater diameter portion of core 33 has in the outer peripheral surface thereof an annular groove 77 into which groove a resilient, axially split annular spring 79 is placed. Due to its resilience, the annular spring 79 contacts the guide surface 35 formed interiorly of the sleeve portion 4, so as to be slidingly movable along such surface. On the other hand, the outer surface of the greater diameter portion of core 33 is spaced from the guide surface 35 with a certain distance therefrom.

The guide surface 35 has formed therein in the sleeve portion 4 a recess 81 into which a ring 82 is seated. Between the ring 82 and the recess 81, there is provided an insert 83 of a non-conductive, heat-resistant material, for example a ceramic fused mass, which insert serves to electrically insulate the ring 82 from the sleeve portion 4. The inner surface of the ring 82 is precisely aligned with the guide surface 35, whereas the inner surface of the insert 83 is slightly displaced in outward direction relative to this guide surface. The spacing between the lower edge of ring 82 and the lower edge of recess 81 is smaller than the height of the annular spring 79. The sleeve portion 4 has at the level of the recess, an aperture through which a connecting sleeve 84 conductively connected to the ring 82 passes to the outer side of the sleeve portion 4. The path of passage of the connecting sleeve 84 through the sleeve portion 4 is likewise electrically insulated. The connecting sleeve 84 of an electrically conductive material forms the terminal of the spark plug 1 for connection to the primary winding of the ignition coil. The lower end of the connector pin 15 includes a stud 41 positioned coaxially with the axial bore 78 of the center electrode 6 and having a diameter dimensioned to establish a clearance fit with the axial bore 78. A compression spring 37 presses against the upper end face of the plunger 31, which spring reacts against a shoulder of sleeve portion 4.

In the embodiment shown, the first pair of contacts is formed by stud 41 and the end 76 of the center electrode 6, while the second pair of contacts is formed by annular spring 79, ring 82 and sleeve portion 4. Closure of the first pair of contacts is effected by causing stud 41 to enter the axial bore 78 when the plunger 31 moves in upward direction. Hereby, stud 41 at the same time closes or interrupts the connection between the passage formed by the axial bore 78 and the pressure chamber 67. The second pair of contacts is closed by the annular spring 79 establishing a conductive connection between the ring 82 and the casing by bridging the distance between the lower edge of ring 82 and the lower edge of recess 81. When the annular spring 79 has moved past the lower edge of recess 81 with its lower edge, the second pair of contacts is thereby re-opened. The function of the spark plug of FIG. 5 is identical to the function of the spark plug of FIG. 1 as explained in connection with FIGS. 2 and 3, with a variation of the preignition in response of the speed of rotation, same as in the embodiment according to FIG. 4, taking place, however. Particular advantages of the embodiment of FIG. 5 are the axial-symmetrical configuration of all components (with the exception of the connecting sleeve 84), the prevention of sliding friction of metal against ceramic material because of the special construction of the second pair of contacts, and the elasticity of the annular spring 79 by which wear between the ring 82 and the annular spring can be compensated. Furthermore, this embodiment is free of the risk that conductive bridges might be formed by wear between the contacts of the second pair of contacts or between the annular spring 79 and the ring 82 as well as the sleeve portion 4.

What I claim is:

1. A spark plug for an internal combustion engine having a battery or magneto ignition system including an ignition coil, said spark plug comprising a casing or body, a center electrode and a connector pin for said center electrode, characterized by a plunger (31) adapted to be axially displaced interiorly of said spark plug (1) by the compression pressure; a first pair of contacts (41, 42; 41, 76) disposed between said connector pin (15) and said center electrode (6), which contacts are closed by movement of said plunger; a terminal (22, 84) for connection to the primary winding (54) of said ignition coil (52); and a second pair of contacts (44, 47; 79, 82, 4) arranged between ground (potential) and said terminal, which contacts are closed and opened by movement of said plunger.

2. The spark plug according to claim 1, characterized by a compression spring (37) acting to bias said plunger (31) in opposition to the compression pressure, thereby to effect a variation of the ignition point in response of the pressure.

3. The spark plug according to claim 1, characterized by a pressure chamber (67) formed within said casing (2, 3, 4) at the side of said plunger (31) opposite from the combustion chamber of said engine, said pressure chamber being connected to said combustion chamber of the engine through at least one passage (64, 65, 66; 78) providing a throttling effect; and means (32, 41) for closing or interrupting such connection during movement of said plunger, thereby effecting a variation of the ignition point in response of the pressure.

4. The spark plug according to claim 1 characterized in that the plunger position in which said plunger (31) closes said first pair of contacts (41, 42; 41, 76), is variable.

5. The spark plug according to claim 1 characterized in that the plunger position in which said plunger (31) closes said second pair of contacts (44, 47; 79, 82, 4), is variable.

6. The spark plug according to claim 1 characterized in that said plunger (31) is of cylindrical configuration and includes a core (33) made of an electrically insulating material through which said center electrode (6) passes; that the end face of said core opposite from said combustion chamber of the engine has formed therein a pair of coaxial bores or apertures (38, 39), the first aperture including an electrically conductive wall portion (42) connected to the center electrode and said second aperture having a wall provided with an electrically conductive contact point (44), said contact point being electrically coupled to ground (potential); that said connector pin (15) terminates in a stud (41) coaxial with said first aperture, said stud defining a clearance fit with the conductive wall portion, with said stud and said wall portion forming said first pair of contacts; and that said terminal (22) of said primary winding (54) is connected to a disc (47) coaxial with said second aperture, said disc being adapted to come into contact with said contact point, whereby said disc and said contact point define said second pair of contacts.

7. The spark plug according to claim 6, characterized in that said connector pin (15) and a conductor (18) connecting said terminal (22) of said primary winding (54) to said disc (47) are connected in gas tight fashion to an insulating body (7) sealingly fitted into a bushing or sleeve (61), said sleeve being sealingly and threadingly engaged with said casing (2) and adapted to be locked in various axial positions.

8. The spark plug according to claim 6, characterized in that said connector pin (15) and a conductor (18) connecting said terminal (22) of said primary winding (54) to said disc (47) are slidingly fitted into an insulating body (7) attached to said casing (2); and that said conductor and said connector pin are each threadingly engaged with a threaded bushing or sleeve (16, 19) inserted into said insulating body, and locked by a nut (17, 21) at their ends protruding outwards from said insulating body.

9. The spark plug according to claim 7, characterized by annular grooves (14) provided in the exposed portion of said insulating body (7).

10. The spark plug according to claim 7, characterized by a groove (23) formed in said insulating body (7) intermediate the free or exposed ends of said connector pin (15) and said terminal (22) for said primary winding (54), said groove being adapted to be engaged with a corresponding web (24) of a socket cap (25).

11. The spark plug according to claim 1, characterized in that said plunger (31) is of cylindrical configuration and includes a core (33) of an electrically insulating material through which core said center electrode (6) passes coaxially, which electrode includes an axial bore (78) in its end opposite from said combustion chamber of the engine; that said connector pin (15) extends coaxially with respect to said center electrode and said plunger to terminate in a stud (41) defining a clearance fit with respect to said axial bore, with said stud and the abovementioned end of said center electrode forming said first pair of contacts; that said core supports with its peripheral surface a resilient annular spring (79) made of electrically conductive material, said spring contacting a guide surface (35) of said casing (3, 4) to be slidingly movable therealong; and that a ring (82) of an electrically conductive material is seated into said guide surface, said ring being insulated with respect to the remainder of the casing and conductively connected to said terminal (22) of said primary winding (54), with said ring and said annular spring in combination with said casing defining said second pair of contacts.

12. The spark plug according to claim 11, characterized in that said casing comprises a threaded (screw-in) portion (3) governing the terminal position of said plunger, and a sleeve portion (4) carrying said ring (82), said components being threadingly engaged with each other and adapted to be locked in various relative positions so as to thereby define the relative position between said ring (82) and said annular spring (79).

13. The spark plug according to claim 11, characterized in that said connector pin (15) is connected to an insulating body (7) sealingly fitted into a bushing or sleeve (73), said sleeve being threaded into said casing or the sleeve portion thereof, respectively, and adapted to be locked in various axial positions.

14. The spark plug according to claim 3, characterized in that said passage comprises at least one groove (64, 65) formed in the guide surfaces (34, 35) of said housing (2, 3, 4) for said plunger (31), said groove opening into said pressure chamber (7) in a position where its end opening into said pressure chamber is closed by said plunger during the movement thereof.

15. The spark plug according to claim 11 in combination with claim 3, characterized in that said axial bore (78) formed in said center electrode (6) is continuous so as to serve as a passage, with the stud (41) provided on said connector pin (15) being adapted to close such passage.

16. The spark plug according to claim 1, characterized by cooling fins (11) formed in said casing (2, 3, 4).

17. The spark plug according to claim 1, characterized in that the outlet ports of said passage are inclined in a manner to blow the gases against said electrode to clean and cool the latter.

* * * * *